US008020322B2

(12) United States Patent
McMullin

(10) Patent No.: US 8,020,322 B2
(45) Date of Patent: Sep. 20, 2011

(54) MULTI-TRACTION EFFECT SHOE CLEAT

(75) Inventor: Faris W. McMullin, Meridian, ID (US)

(73) Assignee: Pride Manufacturing Company, LLC, Brentwood, TN (US)

( * ) Notice: Subject to any disclaimer, the term of this patent is extended or adjusted under 35 U.S.C. 154(b) by 884 days.

(21) Appl. No.: 12/033,180

(22) Filed: Feb. 19, 2008

(65) Prior Publication Data

US 2008/0196276 A1 Aug. 21, 2008

Related U.S. Application Data

(60) Provisional application No. 60/890,308, filed on Feb. 16, 2007.

(51) Int. Cl.
*A43B 5/00* (2006.01)

(52) U.S. Cl. ..... 36/134; 36/127

(58) Field of Classification Search ..... 36/134, 36/127, 59 R, 59 C

See application file for complete search history.

(56) References Cited

U.S. PATENT DOCUMENTS

| | | | | |
|---|---|---|---|---|
| 6,023,860 | A * | 2/2000 | McMullin | 36/127 |
| 6,209,230 | B1 * | 4/2001 | Curley, Jr. | 36/127 |
| 6,305,104 | B1 | 10/2001 | McMullin | |
| D452,062 | S * | 12/2001 | Savoie | D2/962 |
| 6,675,505 | B2 | 1/2004 | Terashima | |
| 6,834,446 | B2 * | 12/2004 | McMullin | 36/134 |
| D509,050 | S * | 9/2005 | Savoie | D2/962 |
| 7,134,226 | B2 | 11/2006 | Robinson, Jr. et al. | |
| 7,726,047 | B1 * | 6/2010 | MacNeill et al. | 36/134 |
| 2001/0011429 | A1 | 8/2001 | Peabody | |
| 2003/0172556 | A1 * | 9/2003 | Terashima | 36/134 |
| 2005/0108902 | A1 * | 5/2005 | McMullin | 36/127 |
| 2007/0101618 | A1 * | 5/2007 | Peake | 36/134 |
| 2008/0072460 | A1 * | 3/2008 | Robinson et al. | 36/134 |

* cited by examiner

*Primary Examiner* — Ted Kavanaugh

(74) *Attorney, Agent, or Firm* — Edell, Shapiro & Finnan, LLC

(57) ABSTRACT

A cleat for a shoe has an annular array of different types of angularly spaced traction elements disposed about and depending from a hub periphery. The array includes plural types of flexible traction elements and plural types inflexible traction elements interleaved within the array. The dynamic elements are longer than the static elements and are of two different lengths. The static elements have two different configurations. The flexible elements are sufficiently close to adjacent inflexible elements to permit grass to be trapped therebetween when the flexible elements are flexed.

19 Claims, 4 Drawing Sheets

MULTI-TRACTION EFFECT SHOE CLEAT

CROSS REFERENCE TO RELATED APPLICATION

This application claims priority from U.S. Provisional Patent Application Ser. No. 60/890,308 entitled "MULTI-TRACTION EFFECT SHOE CLEAT" filed Feb. 16, 2007. The disclosure of this provisional patent application is incorporated herein by reference in its entirety.

BACKGROUND

1. Technical Field

The present invention pertains to improvements in shoe cleats, and, more particularly, to such cleats having different types of traction elements on the same cleat. Although the cleats described herein have particular utility when used with golf shoes, it is to be understood that the principles of the invention have applicability for cleats used with any type of shoe for which enhanced traction is desired.

2. Discussion of Prior Art

In U.S. Pat. No. 6,675,505 (Terashima) there is disclosed a shoe cleat having a ring of traction elements that are disposed about the periphery of a hub and that alternate in length. The longer elements are described as being more flexible than the shorter elements but, as stated in the patent, this flexibility is intentionally limited so that the element "hardly bends on grass or turf and penetrates into grass and provides an excellent grip". Not recognized in the Terashima patent is the fact that such penetration into grass damages roots, leaves indentations and is generally highly undesirable for use on golf course greens. This problem of turf penetration was addressed in my U.S. Pat. No. 6,305,104. In that patent I disclose a cleat made up of an annular array of angularly spaced traction elements that are sufficiently flexible to permit the elements, when flexed upward under load, to trap blades of grass against the sole of the shoe. These traction elements are referred to as dynamic traction elements because of the traction provided by virtue of their traction-producing flexure under load. This flexure, during which the distal tips of the traction elements spread radially outward along the turf rather than penetrating the turf, avoids damage to greens.

SUMMARY OF THE INVENTION

In accordance with the present invention, a cleat for a shoe has an annular array of angularly spaced traction elements disposed about and depending from the cleat hub periphery. The array preferably includes plural types of highly flexible (i.e., dynamic) traction elements and plural types relatively inflexible (i.e., static) traction elements disposed interspersed within the array. The dynamic elements are longer than the static elements and make initial contact as the cleat is pressed toward the ground. In a preferred embodiment, the dynamic elements in the array are of two different lengths that positionally alternate in the array such that some of the dynamic elements make initial contact with the turf prior to the others. The dynamic elements are sufficiently soft and resiliently flexible to trap grass against the shoe sole or an extended cleat hub when fully flexed to provide dynamic traction in the manner described in my U.S. Pat. No. 6,305,104. The static elements are harder and substantially inflexible and serve to enhance traction by bearing on turf with short grass, i.e., where the grass blades are not long enough to be trapped by the dynamic elements.

As the shoe approaches the ground, the longer dynamic elements first make contact and begin to flex. In this state the tips of the dynamic elements move radially outward and thereby provide initial frictionally-produced traction, even on short-bladed grass. Eventually the shorter static elements also contact the ground and bear some of the load from the weight of the wearer of the shoe. In this manner the static elements reduce wear on the dynamic element and extend the useful life of the cleat. The dynamic elements, by virtue of contacting the turf, can be configured to provide some tractional assistance to the static elements on short grass, even without trapping any grass blades against the shoe sole. If desired, the tips of the dynamic elements may terminate in small studs or barbs to enhance this tractional assistance.

In a preferred embodiment the static elements are provided in two different positionally alternating configurations. A first static element configuration has a relatively broad bottom surface with one or more small studs or barb-like projections extending downwardly for engaging the ground to enhance static traction. This first element configuration has an outwardly facing surface that is faceted or recessed to enhance lateral traction as the cleat moves horizontally through grass. A second static element configuration has a relatively narrow (i.e., small surface area) bottom surface or edge for engaging the ground to enhance static traction. The outwardly facing surface of this second configuration has a smooth outwardly facing surface. In the preferred embodiment, the plane defined by the distal ends of the studs in the first static configuration is co-planer with the relatively narrow bottom edge of the second configuration. The planes defining the distal tips of the dynamic elements when unflexed are disposed below (i.e., further from the cleat hub) the common plane of the distal ends of the static elements.

Another advantageous feature of the invention is the sizing and positioning of the dynamic traction elements sufficiently close to the laterally adjacent static traction elements to permit grass to be trapped therebetween when the dynamic elements are flexed under load. The result is a "shearing" or friction effect in which the several grass blades disposed between the two elements are frictionally trapped or grabbed to provide additional lateral traction. In the preferred embodiment the static and dynamic elements are molded from different polymer materials chosen to enhance the friction between the two elements.

DESCRIPTION OF THE PREFERRED EMBODIMENTS

Figure 1:
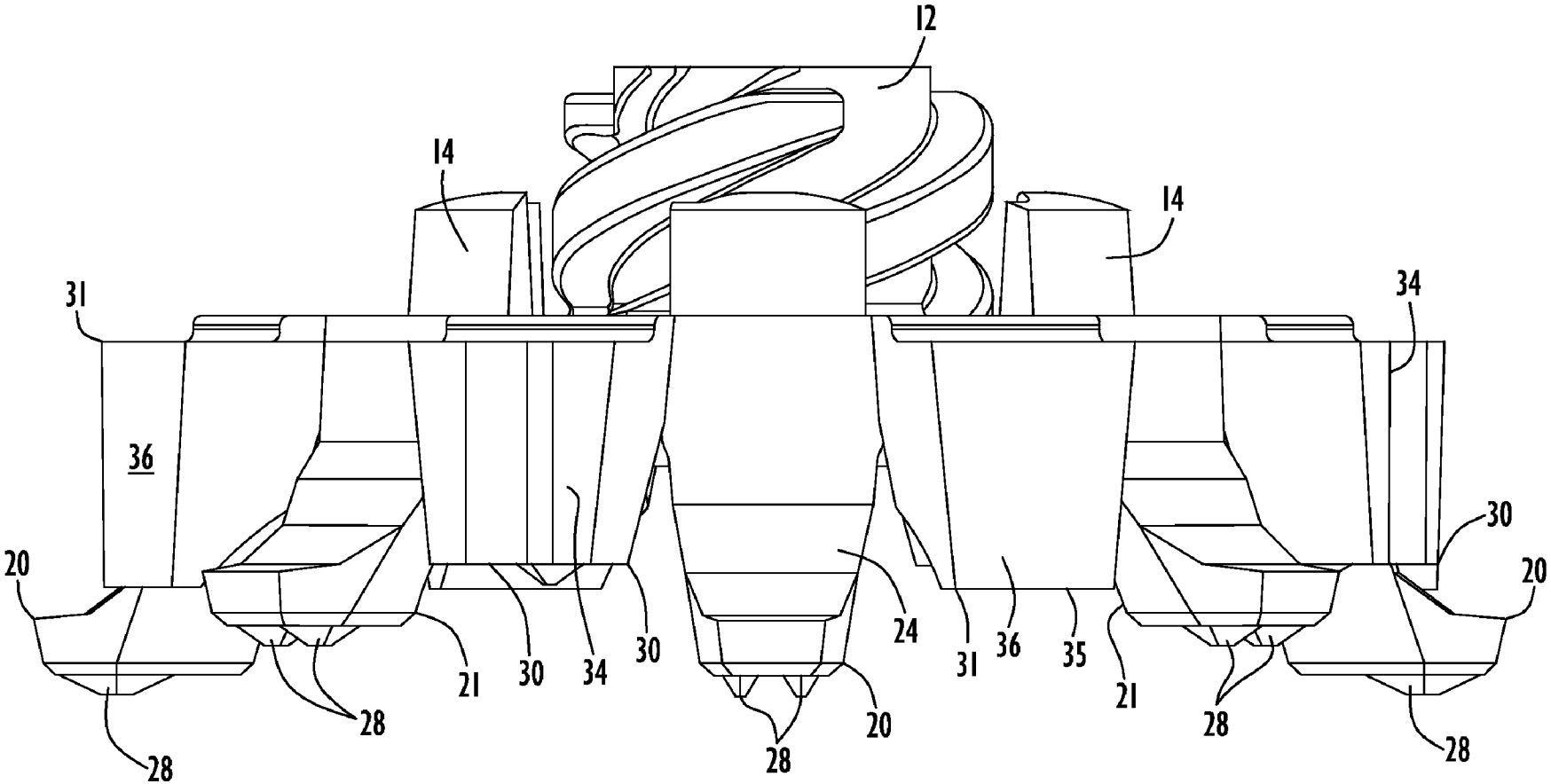
FIG. 1 is a side view in elevation of a preferred embodiment of a cleat according to the present invention.
Figure 2:
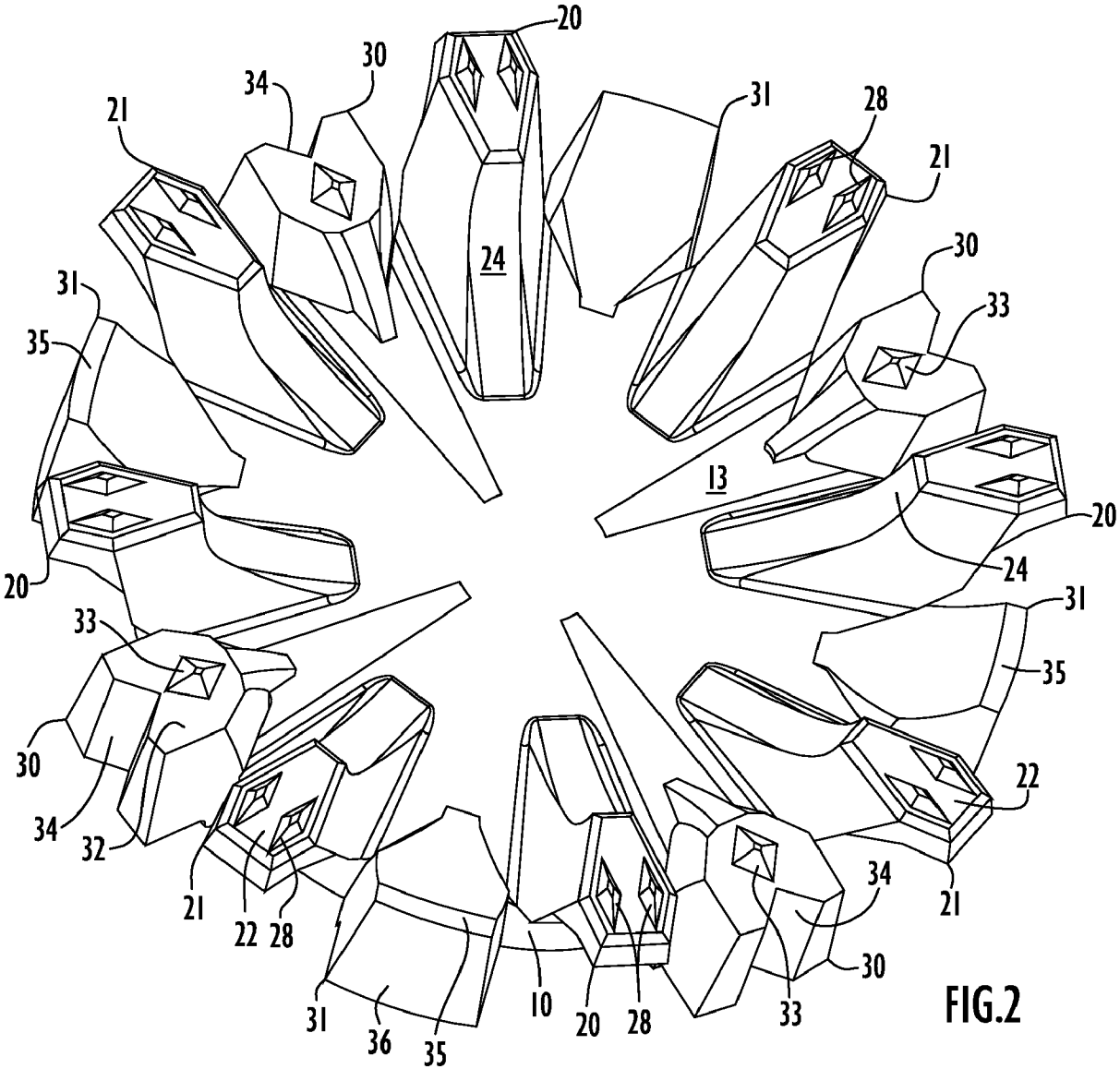
FIG. 2 is a bottom view in perspective of the cleat of FIG. 1.
Figure 3:
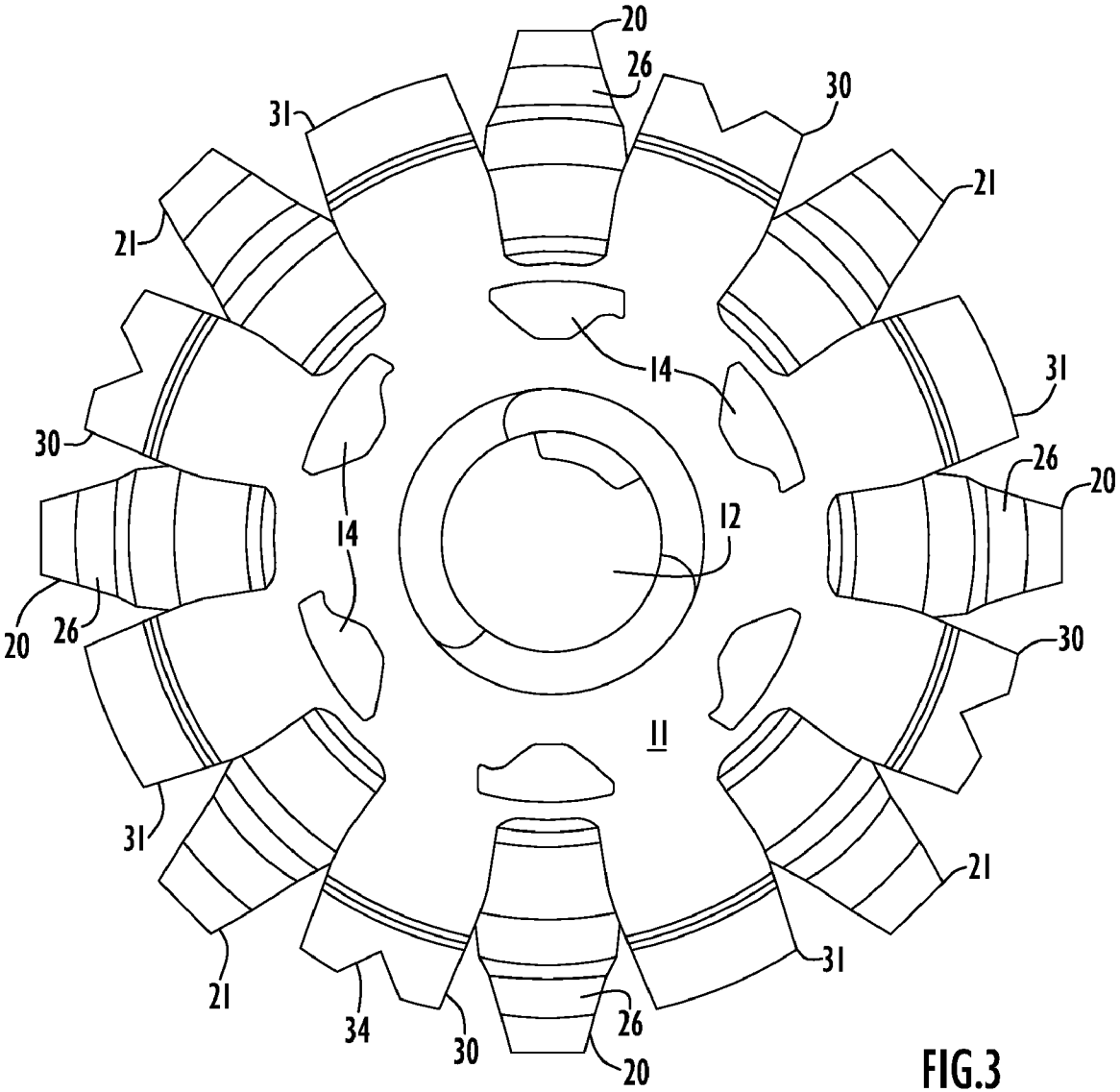
FIG. 3 is a top view in plan of the cleat of FIG. 1.
Figure 4:
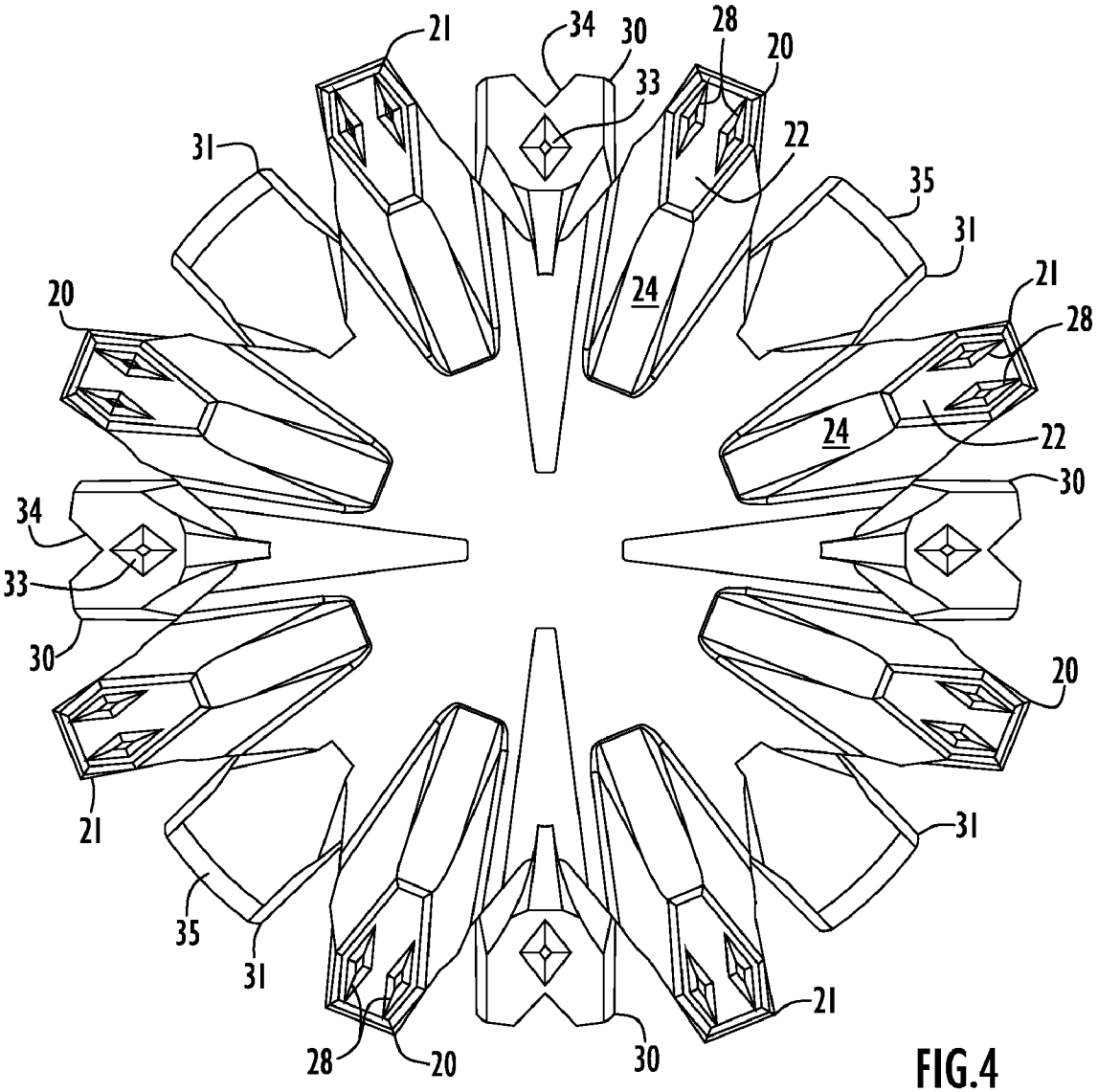
FIG. 4 is a bottom view in plan of the cleat of FIG. 1.

The following detailed explanations of the drawings and of the preferred embodiments reveal the methods and apparatus of the present invention.

Referring specifically to the drawings, a traction cleat includes a hub 10 of generally circular configuration with a top surface 11 and a bottom surface 13. An imaginary central axis 15 extends perpendicularly through the center of the hub. Although circular in the described embodiment, it will be appreciated that hub 10 need not be circular or even symmetrical about axis 15.

An annular array of angularly spaced traction elements disposed along the periphery of the hub includes four sub-arrays, each sub array including two different types of dynamic traction elements and two different types of static traction elements. Specifically, highly flexible (i.e., dynamic) traction elements 20, 21 extend downwardly and outwardly from the rim or periphery of hub 10. Elements 20 and 21 are of different length, with element 20 being somewhat longer than element 21, and one of each type is disposed in each sub-array. Relatively inflexible (i.e., static) traction elements 30, 31 are disposed interspersed with the dynamic elements in each sub-array, there being one each of elements 20, 30, 21 and 31 in each sub-array. Elements 30, 31 are of different configuration but are of substantially the same length. The static elements positionally alternate with the dynamic elements such that the angular sequence of elements in each sub-array is 20, 30, 21, 31, and the sub-arrays are substantially the same. It should be noted, however, that the sub-arrays need not be the same with respect to the principles of the present invention. In the preferred embodiment there are sixteen traction elements, including eight dynamic elements and eight static elements, resulting in four repeating sub-arrays of angularly spaced elements 20, 30, 21, 31 in an endless array. It will be appreciated that the number of sub-arrays, the number of individual elements and the specific element configurations can vary within the scope of the invention.

The longer dynamic element 20 has an interiorly (i.e., generally toward axis 15) and downwardly facing concave surface 24 extending from the bottom surface 13 of the hub and terminating at a flat irregular pentagonal distal tip surface 22. The outwardly and generally upwardly facing surface 26 of element 20 extends downwardly and outwardly from the hub periphery in step-like sections terminating at tip surface 22. Specifically, the downwardly successive sections alternate in defining larger and smaller outward angles with axis 15 to provide a series of bumps or protuberances defining a ski slope-like configuration. The last or downward-most section of element 20 is substantially perpendicular to tip surface 22, and the intersection therebetween is preferably beveled as shown.

One or more narrow pyramidal barbs 28 are preferably provided to extend downward from tip surface 22 to engage the turf and thereby enhance traction. The barbs 28 thus add a static traction component to dynamic traction element 20. In particular, the engagement of the turf by barbs 28 when the wearer of the cleat begins to step enhances lateral traction. In addition, as the wearer of the cleat begins to step down to place the traction element 20 under load, the traction element flexes and spreads radially outward which causes the barbs 28 to scrape along the turf and thereby provide tractional assistance.

The sides of traction element 20 extend generally radially from the interiorly facing surface 24 to the multi-section outwardly facing surface 26. Surface 26 is angularly larger than the more radially inwardly positioned surface 24.

The shorter dynamic traction element 21 is similar in structure to, but shorter than, element 20, and like reference numerals are used in the drawings to designate the similar parts of these elements. The difference in length between elements 20 and 21 is effected primarily in the middle section thereof which is preferably between twenty and forty eighty percent shorter than the length of the middle section of element 20. In one exemplary embodiment, not to be construed as limiting on the scope of the invention, the distal end of the longer dynamic traction element 20 extends approximately 0.16 inch below the bottom surface 13 of hub 10; the distal end of the shorter element 21 extends approximately 0.125 inch below the bottom surface 13. The effect of the different lengths of dynamic traction elements is to provide a cascade-like increase in traction as the wearer of the cleat steps down and place the elements under load. More particularly, elements 20 make initial contact with the turf and provide traction in the manner described. As that traction begins to take effect, the shorter traction elements 21 begin to flex and supply traction that is additive to the traction provided by elements 20.

Static traction element 30 is configured with a relatively broad bottom surface 32 with one or more small studs or barb-like projections 33 extending downwardly for engaging the ground to enhance static traction. The outwardly facing surface of element 30 is recessed inwardly in the form of a V-shaped notch 34 defined by two inwardly converging facets to enhance lateral traction as the cleat moves horizontally through grass by directing grass blades into nadir of the notch. The second static element 31 is configured with a radially narrow (i.e., small surface area) bottom surface or edge 35 for engaging the ground to enhance static traction. This element configuration has a smooth outwardly facing surface 36. In the preferred embodiment the plane defined by the distal ends of the studs 33 in static elements 30 is co-planer with the relatively narrow bottom edges 35 of the elements 31. The two planes defining the distal tips 22 of the dynamic elements 20, 21, respectively, when these elements are unflexed, are disposed below (i.e. further from the cleat hub 10) than the common plane of the distal ends of the static elements 30, 31. In the example noted above where the distal tip of dynamic traction element 20 is disposed 0.16 inch from surface 13, the common distal plane is disposed approximately 0.10 inch from surface 13.

The lateral spacing between the each dynamic traction element 20, 21 and its adjacent static element 30, 31 near hub 10 is sufficiently small to permit several grass blades to fit therebetween and be trapped as the dynamic elements flex under load. The result is a "shearing" or friction effect in which the several grass blades disposed between the two elements are frictionally grabbed to provide additional lateral traction. The spacing between the elements required to provide this function is typically on the order of one to two millimeters or less. This shearing effect is enhanced when, as in the preferred embodiment, the dynamic and static traction elements are made of different polymer materials, particularly materials that do not readily bond to one another.

Extending upwardly from the top surface 11 of hub 10 is a threaded shaft 12 adapted to be received in and engaged by a threaded receptacle mounted in a shoe. A plurality of angularly spaced locking posts 14 also extend upwardly from surface 11 and are adapted to be engaged and locking relation by projections disposed in the aforesaid receptacle to prevent the cleat from inadvertently rotating and becoming disengaged from the receptacle. This connection and locking arrangement is described and illustrated in U.S. Pat. No. 7,107,718, the entire disclosure of which is incorporated herein by reference. It is to be noted that there are numerous types of connection and locking arrangements used for cleats of the general type disclosed herein, and that the particular arrangement shown in the accompanying drawings is by way of example and not, per se, part of the present invention.

One of the advantages of the cleat of the present invention is that it offers improved traction in short grass on fairways and tee boxes because of the static traction elements 30, 31. The mowing heights on golf courses have been lowered over the years to the point that fairways are almost the height that only tee boxes used to be. The shorter grass makes it difficult for the dynamic traction elements to provide their full effectiveness; that is, it is difficult to trap short grass blades between the flexed dynamic elements and the shoe sole or hub. The static traction elements bear against the shorter grass turf after the dynamic elements have been flexed under load to provide better traction in the shorter grass. The dynamic traction elements do provide some meaningful traction in the short grass by virtue of the fact that they spread outwardly when placed under load and by the addition of barbs 28.

The cleat illustrated in the preferred embodiment may be formed in a single molding step using one or more different polymers of the type conventionally used for plastic cleats. Alternatively, and preferably, the fabrication may comprise two molding steps or "shots" wherein the static elements, the threaded connector, the locking posts and the top of the hub are molded in the first step, and the bottom of the hub and the dynamic traction elements are molded in another step. The dynamic traction elements are made from a softer and more flexible polymer than that used for the static elements to enable the dynamic elements to flex and function as described herein. The polymer material used for the dynamic traction elements 20, 21 preferably has a hardness on the Durometer scale in the range of 82 A to 90 A. The harder static traction elements preferably have a Durometer in the range of 67 D to 75 D. In a preferred embodiment, polyurethane may be used for both materials but to increase the hardness and durability of the polyurethane for the static elements, Kevlar® (aramid fusion pulp may) be added to the polyurethane in an amount in the range of 5% to 10% by weight. The resulting surface of the static elements resists abrasion to a significantly greater extent than using only polyurethane.

If desired, the different polymer materials may have different colors to enhance the aesthetic appeal of the cleat. The colors may be selected to correspond to the color theme used by businesses, schools, and the like.

Although the illustrated preferred embodiment of the invention is a cleat with a circular hub that is both axially and diametrically symmetrical, it will be understood that symmetry is not a feature of the invention, and the asymmetrical cleats can embody the principles of the invention to provide directionally oriented traction components, as desired.

Other modifications, variations and changes will be suggested to those skilled in the art in view of the teachings set forth herein. It is therefore to be understood that all such variations, modifications and changes are believed to fall within the scope of the present invention. Although specific terms are employed herein, they are used in a generic and descriptive sense only and not for purposes of limitation.

I claim:

1. A cleat for footwear comprising:

a hub having a top surface, a bottom surface, a periphery and a longitudinal axis oriented substantially perpendicular to said top and bottom surfaces;

connector means secured to said top surface of said hub for enabling the cleat to be attached to a connector mounted in a shoe sole;

an array of plural different types of angularly spaced traction elements secured to and depending from said bottom surface of said hub proximate said periphery;

wherein said traction elements are positionally angularly alternated in said array;

wherein a first type of said traction elements is a first dynamic traction element that is sufficiently flexible in response to bearing a load comprising the weight of a wearer of the footwear to trap grass blades between itself and an outsole of footwear to which the cleat is connected;

wherein a second type of said traction elements is a first static traction element that is relatively inflexible in response to bearing said load and is shorter than said first dynamic traction element; and wherein a third type of said traction elements is a second dynamic traction element that is sufficiently flexible in response to bearing said load to trap grass blades between itself and the outsole of footwear to which the cleat is connected, said second dynamic traction element being shorter than said first dynamic traction element but longer than said first static traction element.

2. The cleat of claim 1 wherein a fourth type of said traction elements is a second static traction element that is relatively inflexible in response to said load and is substantially as long as said first static traction element.

3. The cleat of claim 2 wherein said dynamic traction elements are molded from a polymer material having a hardness on the Durometer scale in the range of 82A to 90A, and wherein said static traction elements are molded from a polymer material having a hardness on the Durometer scale in the range of 67D to 75D.

4. The cleat of claim 2 wherein said array includes plural sub-arrays, each sub-array including at least one each of said first, second, third and fourth types of cleats.

5. The cleat of claim 2 wherein said array is symmetrical about said axis.

6. The cleat of claim 2 wherein said first static traction element has a bottom surface with a relatively large surface area, and wherein said second type of static traction element has a bottom surface with a surface area that is much smaller than said large surface area.

7. The cleat of claim 2 wherein said first static traction element has a radially outward facing surface having a recessed notch defined therein, and wherein said second static traction element has a continuously smooth and unrecessed radially outward facing surface.

8. The cleat of claim 2 wherein said first static traction element further includes at least on downwardly projecting barb disposed on its bottom-most surface.

9. The cleat of claim 1 wherein said first dynamic traction element further includes at least one downwardly projecting barb disposed on its bottom-most surface.

10. A cleat for footwear comprising:

a hub having a top surface, a bottom surface, a periphery and a longitudinal axis oriented substantially perpendicular to said top and bottom surfaces;

connector means secured to said top surface of said hub for enabling the cleat to be attached to a connector mounted in a shoe sole;

an array of plural different types of angularly spaced traction elements secured to and depending from said bottom surface of said hub proximate said periphery;

wherein said traction elements are positionally angularly alternated in said array;

wherein a first type of said traction elements is a first dynamic traction element that is sufficiently flexible in response to bearing a load comprising the weight of a wearer of the footwear to trap grass blades between itself and an outsole of footwear to which the cleat is connected; and wherein a second type of said traction elements is a first static traction element that is relatively inflexible in response to bearing said load and is shorter than said first dynamic traction element; and wherein at least one of said first dynamic traction elements is disposed sufficiently proximate an adjacent one of said first static traction element to trap and pinch grass therebetween when said one of said first dynamic traction elements is flexed under load to thereby provide a friction effect in which grass blades disposed between said first dynamic and first static elements are frictionally trapped by said first dynamic and first static elements to provide lateral traction.

11. The cleat of claim 10 wherein said dynamic traction elements are molded from a polymer material having a hardness on the Durometer scale in the range of 82A to 90A , and wherein said static traction elements are molded from a polymer material having a hardness on the Durometer scale in the range of 67D to 75D.

12. A cleat for footwear comprising:

a hub having a top surface, a bottom surface and a longitudinal axis oriented substantially perpendicular to said top and bottom surfaces;

connector means secured to said top surface of said hub for enabling the cleat to be attached to a connector mounted in a shoe sole;

at least a first dynamic traction element that is sufficiently flexible in response to bearing a load comprising the weight of a wearer of the footwear to trap grass blades between itself and an outsole of footwear to which the cleat is connected; and at least a first static traction element that is relatively inflexible in response to said load and is shorter than said first dynamic traction element;

wherein said first dynamic traction element is disposed sufficiently proximate said first static traction element to trap and pinch grass between said elements when said first dynamic traction element is flexed under load to thereby provide a friction effect in which grass blades disposed between said first dynamic and first static elements are frictionally trapped by said first dynamic and first static elements to provide lateral traction.

13. The cleat of claim 12 wherein said dynamic traction elements are longer than said static traction elements.

14. The cleat of claim 13 further comprising:

at least a second dynamic traction element that is sufficiently flexible in response to bearing a load comprising the weight of a wearer of the footwear to trap grass blades between itself and an outsole of footwear to which the cleat is connected, said second dynamic traction element being longer than said first dynamic traction element.

15. The cleat of claim 14 further comprising:

at least a second static traction element that is relatively inflexible in response to said load and that has a configuration that is different from the configuration of the first static traction element.

16. The cleat of claim 13 further comprising:

at least a second static traction element that is relatively inflexible in response to said load and that has a configuration that is different from the configuration of the first static traction element.

17. The cleat of claim 13 wherein said first static traction element has a radially outward facing surface having a recessed notch defined therein to enhance lateral traction.

18. A cleat for footwear comprising:

a hub having a top surface, a bottom surface and a longitudinal axis oriented substantially perpendicular to said top and bottom surfaces;

connector means secured to said top surface of said hub for enabling the cleat to be attached to a connector mounted in a shoe sole;

at least a first dynamic traction element that is sufficiently flexible in response to bearing a load comprising the weight of a wearer of the footwear to trap grass blades between itself and an outsole of footwear to which the cleat is connected; and at least a first static traction element that is relatively inflexible in response to said load and is shorter than said first dynamic traction element, said first static traction element having a radially outward facing surface having a radially inwardly recessed notch defined therein by two radially inwardly converging facets extending substantially the entire length of said radially outward facing surface to enhance lateral traction as the cleat moves horizontally through grass by directing grass blades into a nadir of the notch.

19. The cleat of claim 18 wherein said first static traction element further includes at least one downwardly projecting barb disposed on its bottom-most surface.

* * * * *